US010864736B2

(12) United States Patent
Fukuda et al.

(10) Patent No.: US 10,864,736 B2
(45) Date of Patent: Dec. 15, 2020

(54) LIQUID DISCHARGE DEVICE

(71) Applicant: Seiko Epson Corporation, Tokyo (JP)

(72) Inventors: Shunya Fukuda, Azumino (JP); Hiroki Miyajima, Matsumoto (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 16/515,120

(22) Filed: Jul. 18, 2019

(65) Prior Publication Data

US 2020/0023644 A1 Jan. 23, 2020

(30) Foreign Application Priority Data

Jul. 19, 2018 (JP) ..... 2018-135435

(51) Int. Cl.
*B41J 2/165* (2006.01)
*B41J 2/14* (2006.01)

(52) U.S. Cl.
CPC ..... *B41J 2/16505* (2013.01); *B41J 2/14233* (2013.01); *B41J 2002/14419* (2013.01); *B41J 2002/14491* (2013.01)

(58) Field of Classification Search
CPC ..... B41J 2/14233; B41J 2/1609
See application file for complete search history.

(56) References Cited

U.S. PATENT DOCUMENTS 6,079,810 A * 6/2000 Davis ..... B41J 2/1609 347/47
2002/0036678 A1 3/2002 Ito et al.
2006/0192813 A1 8/2006 Silverbrook
2015/0042719 A1* 2/2015 Fukuzawa ..... B41J 2/14233 347/29
2015/0174901 A1 6/2015 Akahane et al.
2015/0224776 A1 8/2015 Ichikawa et al.
2015/0321475 A1 11/2015 Tatsumi et al.
2017/0313078 A1 11/2017 Ueki et al.

FOREIGN PATENT DOCUMENTS

EP 3 300 895 A1 4/2018
JP 2000-177119 A 6/2000
JP 2003-165221 A 6/2003
JP 2014-113787 A 6/2014
JP 2015-057315 A 3/2015
JP 2017-165051 A 9/2017
JP 6299959 B2 3/2018

OTHER PUBLICATIONS

Extended European Search Report for Application No. EP 19 18 6671 dated Dec. 19, 2019 (9 pages).

* cited by examiner

*Primary Examiner* — Lam S Nguyen
(74) *Attorney, Agent, or Firm* — Harness, Dickey & Pierce, P.L.C.

(57) ABSTRACT

A liquid discharge device includes a channel member, a nozzle plate, a flexible film, a support, and a lid. The channel member has a storage chamber that stores liquid. The nozzle plate has a nozzle through which the liquid stored in the storage chamber is discharged. The flexible film forms part of walling of the storage chamber. The support has an opening that surrounds a space where the flexible film is exposed at a side of the flexible film opposite the storage chamber. The lid is configured to cover the flexible film across the space, and is bonded, by an adhesive, to a surface of the support. The support has a groove provided in the surface bonded to the lid. The adhesive is also disposed in the groove.

8 Claims, 7 Drawing Sheets

LIQUID DISCHARGE DEVICE

The present application is based on, and claims priority from, JP Application Serial Number 2018-135435, filed Jul. 19, 2018, the disclosure of which is hereby incorporated by reference herein in its entirety.

BACKGROUND

1. Technical Field

The present disclosure relates to a liquid discharge device.

2. Related Art

A liquid discharge device discharges from a nozzle liquid such as ink stored in a storage chamber. In the liquid discharge device, pressure variation in the storage chamber may affect discharge of the liquid from the nozzle. A liquid discharge device described in JP-A-2015-057315 has a storage chamber having walling partially formed by a flexible film. The pressure variation in the storage chamber is absorbed by deformation of the flexible film. This liquid discharge device has a space that accommodates the deformation of the flexible film on a side of the flexible film opposite the storage chamber. The space is defined by a support having an opening and a lid bonded to the support by an adhesive so as to cover the opening.

In order to more firmly bond the lid and the support to each other, there is contemplated a structure in which the sizes of surfaces of the lid and the support that face each other are increased, more specifically, the sizes of the surfaces where the adhesive is applied are increased. However, when the sizes of the surfaces of the lid and the support facing each other are increased, for example, a gap is likely to be formed between the lid and the support due to, for example, distortion of the facing surfaces or the like. When such a gap is formed, there is a problem in that clogging of the nozzle or other troubles are likely to occur because of an increase in viscosity of the liquid resulting from evaporation of water in the storage chamber through this gap and the flexible film.

SUMMARY

To address the above-described problem, according to an aspect of the present disclosure, a liquid discharge device includes a channel member, a nozzle plate, a flexible film, a support, and a lid. The channel member has a storage chamber that stores liquid. The nozzle plate has a nozzle through which the liquid stored in the storage chamber is discharged. The flexible film forms part of walling of the storage chamber. The support has an opening that surrounds a space where the flexible film is exposed at a side of the flexible film opposite the storage chamber. The lid is bonded, by an adhesive, to a surface of the support on a side of the support opposite the flexible film so as to cover the opening. In the surface of the support, a groove is provided at a position opposite the nozzle with the space interposed therebetween. The adhesive is also disposed in the groove.

DESCRIPTION OF EXEMPLARY EMBODIMENTS

First Embodiment

Figure 1:
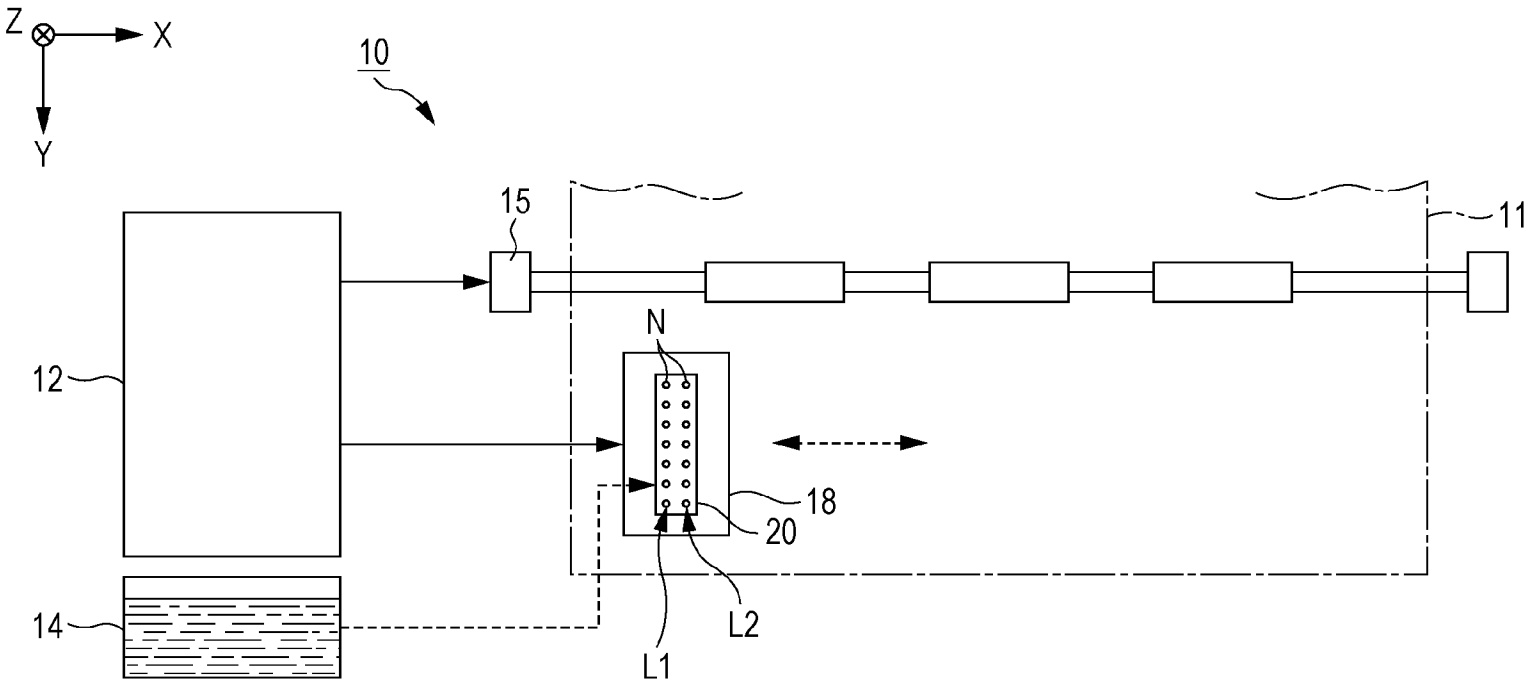
FIG. 1 illustrates the structure of a liquid discharge device according to a first embodiment.

FIG. 1 illustrates a structure that exemplifies a liquid discharge device 10 according to a first embodiment. The liquid discharge device 10 is an ink jet printer that discharges ink exemplifying liquid to a medium 11. Typically, the medium 11 is a printing paper. However, as the medium 11, a printing target formed of any material such as a resin film or cloth may be used. A liquid container 14 in which the ink is stored is provided in the liquid discharge device 10. As the liquid container 14, for example, a cartridge removably mountable to the liquid discharge device 10, a bag-shaped ink pack formed of a flexible film, or an ink tank able to be replenished with the ink is used. The ink stored in the liquid container 14 may be a black ink or a color ink.

The liquid discharge device 10 includes a controller 12, a transport mechanism 15, a carriage 18, and a liquid discharge head 20. The controller 12 includes, for example, a processing circuit such as a central processing unit (CPU) or a field programmable gate array (FPGA) and a storage circuit such as semiconductor memory. The controller 12 controls the elements of the liquid discharge device 10 in a centralized manner. The transport mechanism 15 transports the medium 11 in the Y direction under the control of the controller 12. The Y direction is an example of a first axis.

The liquid discharge head 20 is mounted in the carriage 18. Although a single liquid discharge head 20 is mounted in the carriage 18 in the example illustrated in FIG. 1, a plurality of liquid discharge heads 20 may be mounted in the carriage 18. The carriage 18 causes the liquid discharge head 20 to reciprocate between the positive side and the negative side in the X direction under the control of the controller 12. The X direction is perpendicular to the Y direction in which the medium 11 is transported. The X direction is an example of a second axis. The liquid container 14 may be mounted in the carriage 18 together with the liquid discharge head 20.

The liquid discharge head 20 discharges the ink supplied from the liquid container 14 from a plurality of nozzles N to the medium 11 under the control of the controller 12. When the liquid discharge head 20 discharges the ink to the medium 11 in parallel with transportation of the medium 11 performed by the transport mechanism 15 and repetitive reciprocation of the carriage 18, a desired image is formed on the surface of the medium 11. A direction perpendicular to the X-Y plane is represented as the Z direction. A direction in which the ink is discharged by the liquid discharge head 20 corresponds to the Z direction. The X-Y plane is parallel to, for example, the surface of the medium 11.

Figure 2:
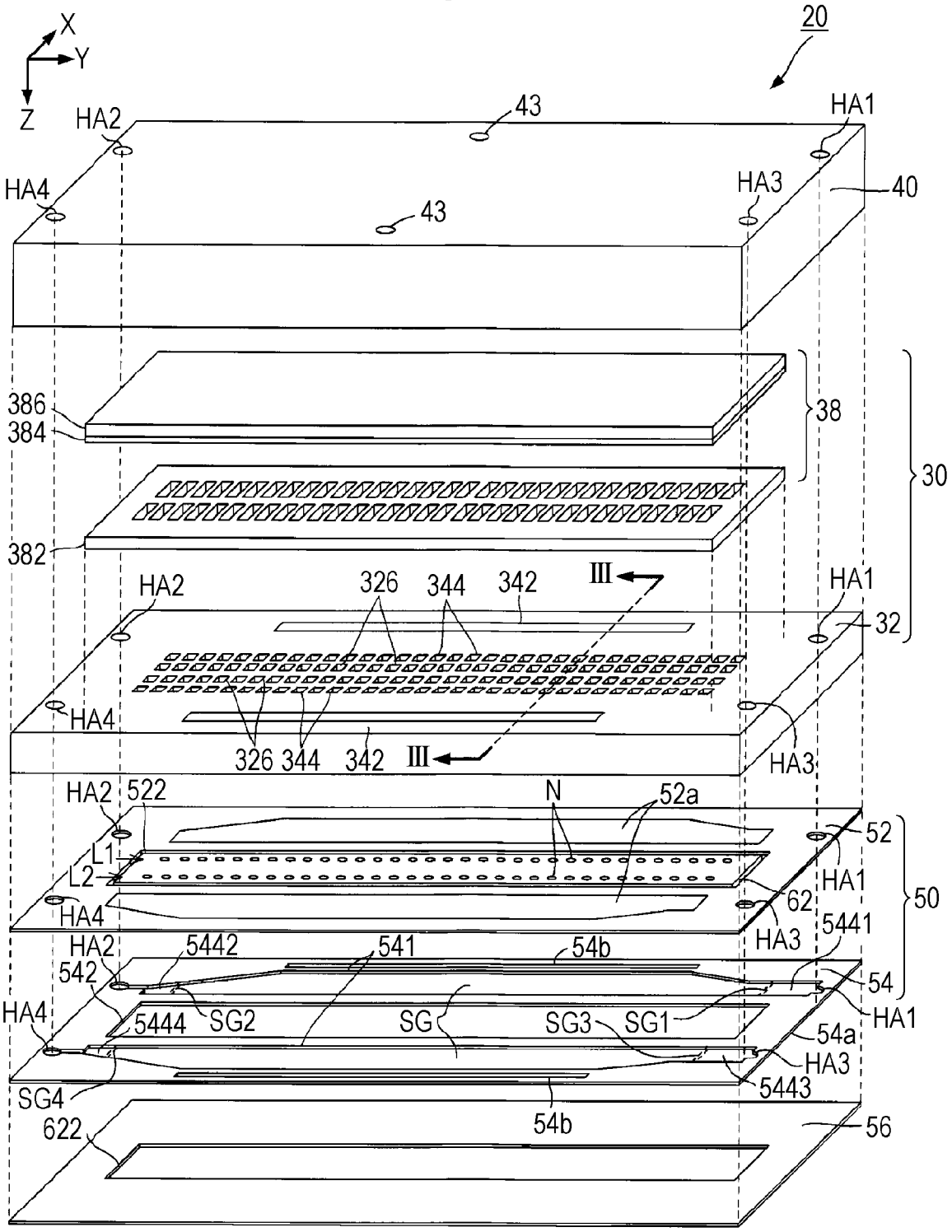
FIG. 2 is an exploded perspective view of a liquid discharge head.
Figure 3:
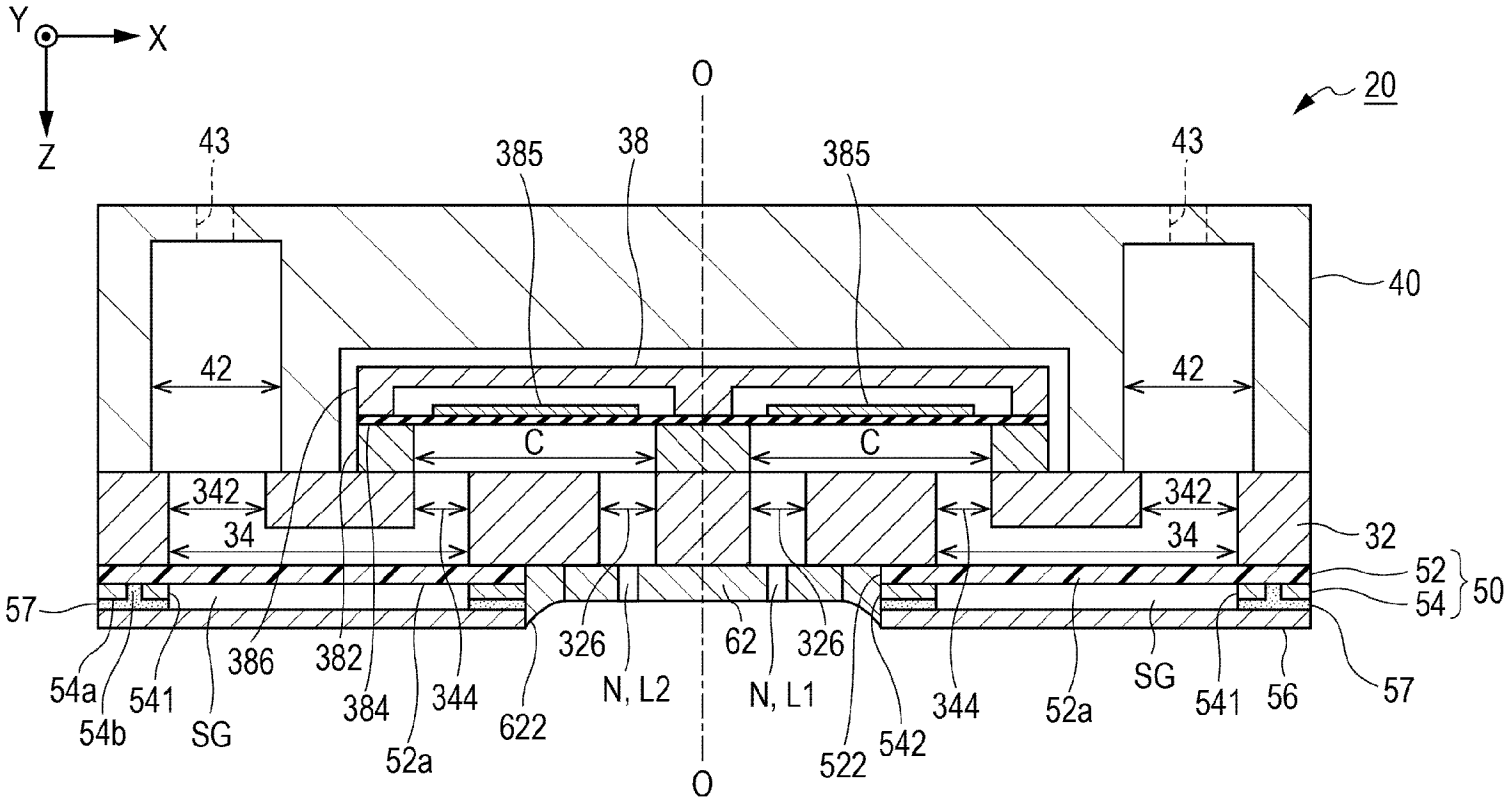
FIG. 3 is a sectional view of the liquid discharge head illustrated in FIG. 2 taken along line III-III.

FIG. 2 is an exploded perspective view of the liquid discharge head 20. FIG. 3 is a sectional view taken along line III-III illustrated in FIG. 2. As exemplified in FIG. 2, the liquid discharge head 20 includes the plurality of nozzles N arranged in the Y direction. The plurality of nozzles N are grouped into a first row L1 and a second row L2. The second row L2 and the first row L1 are arranged in the X direction with a space therebetween. Each of the first row L1 and the second row L2 is a corresponding one of sets of a plurality of the nozzles N arranged linearly in the Y direction. The positions of the nozzles N of the first row L1 in the Y direction can be different from the positions of the nozzles N of the second row L2 in the Y direction. However, in the following example structure, for convenience of description, the positions of the nozzles N of the first row L1 in the Y direction are coincident with the positions of the nozzles N of the second row L2 in the Y direction. As can be understood from FIG. 3, the liquid discharge head 20 has a structure in which elements associated with the nozzles N of the first row L1 and elements associated with the nozzles N of the second row L2 are substantially symmetrically arranged about line O-O.

As exemplified in FIGS. 2 and 3, the liquid discharge head 20 includes a channel forming unit 30. The channel forming unit 30 is a structure that defines channels for supplying the ink to the plurality of nozzles N. The channel forming unit 30 is formed by stacking a channel member 32 and a laminate 38. The laminate 38 includes a pressure chamber substrate 382, a vibrating plate 384, and a protecting plate 386. The channel member 32, the pressure chamber substrate 382, the vibrating plate 384, and the protecting plate 386 are plate-shaped members elongated in the Y direction. The pressure chamber substrate 382 is secured by, for example, an adhesive, to the surface of the channel member 32 on the negative side in the Z direction. The vibrating plate 384 is formed on the surface on the side of the pressure chamber substrate 382 opposite the channel member 32. The protecting plate 386 is secured to the surface on the side of the pressure chamber substrate 382 where no pressure chamber C, which will be described later, is formed. The protecting plate 386 may be omitted.

As exemplified in FIG. 2, a case member 40 is provided on the negative side of the channel forming unit 30 in the Z direction. A nozzle plate 62, a compliance plate 50, and a lid 56 are provided on the positive side of the channel forming unit 30 in the Z direction. The compliance plate 50 includes a flexible film 52 and a support plate 54. The support plate 54 is an example of a support. In general, the elements of the liquid discharge head 20 are, as is the case with the channel member 32 and the like, plate-shaped members elongated in the Y direction and bonded to one another by using, for example, an adhesive.

The nozzle plate 62 is a plate-shaped member in which the plurality of nozzles N are provided. The nozzle plate 62 is provided on the surface of the channel member 32 on the positive side in the Z direction. Each of the plurality of nozzles N is a circular through hole that allows the ink passing therethrough. The plurality of nozzles N included in the first row L1 and the plurality of nozzles N included in the second row L2 are provided in the nozzle plate 62. The nozzle plate 62 is manufactured by processing a silicon (Si) monocrystalline substrate, utilizing, for example, a semiconductor manufacturing technique, examples of which include processing techniques such as dry etching and a wet etching. For the manufacture of the nozzle plate 62, any known material and manufacturing method can be used.

As exemplified in FIGS. 2 and 3, for each of the first row L1 and the second row L2, an inlet 342, a plurality of supply channels 344, a plurality of communication channels 326, and a storage chamber 34 are provided in the channel member 32. The inlet 342 is a through hole having an elongated shape extending in the Y direction in a plan view seen in the Z direction. The supply channels 344 and the communication channels 326 are through holes. The supply channels 344 are formed for the respective nozzles N, and the communication channels 326 are formed for the respective nozzles N. The storage chamber 34 is a space having an elongated shape extending in the Y direction in a plan view seen in the Z direction. The storage chamber 34 allows the inlet 342 and the plurality of supply channels 344 to communicate with one another. The ink is stored in the storage chamber 34. Part of walling defining the storage chamber 34 on the positive side in the Z direction is formed by the flexible film 52 instead of the channel member 32. Each of the plurality of communication channels 326 and a corresponding one of the nozzles N overlap in a plan view seen in the Z direction.

The pressure chamber substrate 382 illustrated in FIGS. 2 and 3 is a plate-shaped member having a plurality of the pressure chambers C for each of the first row L1 and the second row L2. The pressure chambers C are also referred to as cavities. The plurality of pressure chambers C are arranged in the Y direction. Each of the pressure chambers C is formed for a corresponding one of the nozzles N. Each of the pressure chambers C is a space having an elongated shape extending in the X direction in a plan view seen in the Z direction. As is the case with the nozzle plate 62, the channel member 32 and the pressure chamber substrate 382 are manufactured by processing a silicon monocrystalline substrate, utilizing, for example, a semiconductor manufacturing technique. For the manufacture of the channel member 32 and the pressure chamber substrate 382, any known material and manufacturing method can be used.

The vibrating plate 384 is a plate-shaped member that can elastically vibrate. The vibrating plate 384 is formed by, for example, stacking an elastic film formed of an elastic material such as silicon dioxide ($SiO_2$) and an insulating film formed of an insulating material such as zirconium dioxide ($ZrO_2$). Part or the entirety of the vibrating plate 384 may be integrally formed with the pressure chamber substrate 382 by selectively removing part of a plate-shaped member, along the thickness axis, having a predetermined thickness in regions corresponding to the pressure chambers C.

As can be understood from FIG. 3, the pressure chambers C are spaces positioned between the channel member 32 and the vibrating plate 384. The plurality of pressure chambers C are arranged in the Y direction for each of the first row L1 and the second row L2. As exemplified in FIG. 3, the pressure chambers C communicate with the communication channels 326 and the supply channels 344. Accordingly, the pressure chambers C communicate with the nozzles N through the communication channels 326 and communicate with the inlet 342 through the supply channels 344 and the storage chamber 34.

A plurality of piezoelectric elements 385 are formed for each of the first row L1 and the second row L2 on the surface of the side of the vibrating plate 384 opposite the pressure chambers C so as to correspond to the different nozzles N. Each of the piezoelectric elements 385 is a driver element that is deformed when a drive signal is supplied thereto.

Each of the piezoelectric elements 385 is a laminate in which a piezoelectric layer is interposed between two electrodes facing each other. One of the two electrodes facing each other is a common electrode that is formed on the surface of the side of the vibrating plate 384 opposite the pressure chambers C and associated with the plurality of continuously arranged piezoelectric elements 385. A predetermined reference voltage is supplied to the common electrode. The other of the two electrodes facing each other is an individual electrode formed for each of the piezoelectric elements 385. A drive signal that deforms the piezoelectric element 385 is supplied to each of a plurality of the individual electrodes.

A part where the two electrodes facing each other and the piezoelectric layer overlap in a plan view seen in the Z direction functions as the piezoelectric element 385. When the vibrating plate 384 vibrates in accordance with deformation of the piezoelectric element 385, the pressure of the ink in the pressure chamber C varies. This causes the ink filled in the pressure chamber C to be discharged to the outside through the communication channel 326 and the nozzle N. It is noted that the positional relationship between the two electrodes facing each other may be reversed, or both of the two electrodes included in the piezoelectric element 385 may be individual electrodes.

Similarly to the storage chambers 34 of the channel member 32, the case member 40 stores the ink supplied to the plurality of pressure chamber C. As exemplified in FIG. 3, the case member 40 has ink openings 42. The ink openings 42 are each provided for a corresponding one of the first row L1 and the second row L2. In each of the first row L1 and the second row L2, the ink opening 42 and the inlet 342 communicate with each other. The ink is supplied to the storage chamber 34 and a space formed by the inlet 342 and the ink opening 42 through a corresponding one of introduction openings 43 formed in the case member 40.

As exemplified in FIGS. 2 and 3, the compliance plate 50 is provided on the surface of the channel member 32 on the positive side in the Z direction. The compliance plate 50 is an element that suppresses variation of the pressure of the ink in the storage chamber 34. As described above, the compliance plate 50 includes the flexible film 52 and the support plate 54.

The flexible film 52 is a film-shaped flexible member. The flexible film 52 is formed of, for example, polyphenylene-sulfide (PPS), aromatic polyamide (aramid), or the like. The flexible film 52 is thick in the Z direction. The flexible film 52 has a flexible-film opening 522 for exposing the nozzle plate 62. The flexible film 52 is disposed on the surface of the side of the channel member 32 opposite the case member 40 such that the nozzle plate 62 is exposed from the flexible-film opening 522. The flexible film 52 forms the part of the walling of the storage chamber 34 for each of the first row L1 and the second row L2.

In the example illustrated in FIGS. 2 and 3, the flexible film 52 forms the bottom of the storage chamber 34 as the part of the walling of the storage chamber 34. Since the flexible film 52 forms the part of the walling of the storage chamber 34, the pressure variation of the ink in the storage chamber 34 is likely to be absorbed by variation of the flexible film 52 compared to the case where the part of the walling of the storage chamber 34 is not formed by the flexible film 52. Referring to FIG. 3, the part of the walling of the storage chamber 34 of the first row L1 and the part of the walling of the storage chamber 34 of the second row L2 are formed by a single flexible film 52. However, the part of the walling of each of the storage chambers 34 may be formed of a corresponding one of separate flexible films 52.

The support plate 54 is formed of, for example, a metal such as stainless steel (SUS). The support plate 54 has flexible-film exposure openings 541 for exposing walling flexible films 52*a*. The walling flexible films 52*a* are portions of the flexible film 52 that each form the part of the walling of the storage chamber 34. The support plate 54 also has a nozzle-plate exposure opening 542 for exposing the nozzle plate 62. The support plate 54 is provided on the surface of the side of the flexible film 52 opposite the storage chambers 34 such that the walling flexible films 52*a* are exposed from the flexible-film exposure openings 541 and the nozzle plate 62 is exposed from the nozzle-plate exposure opening 542.

As exemplified in FIGS. 2 and 3, the flexible-film exposure openings 541 at least surround respective spaces SG where the walling flexible films 52*a* are exposed. As exemplified in FIG. 2, the spaces SG and the walling flexible films 52*a* extend in the Y direction. According to the present embodiment, no part of the support plate 54 overlaps the storage chambers 34 in a plan view seen in the Z direction.

As exemplified in FIGS. 2 and 3, the lid 56 is provided on the positive side of the support plate 54 in the Z direction. The lid 56 is formed of, for example, a metal such as stainless steel (SUS). The lid 56 has a nozzle-plate opening 622 for exposing the nozzle plate 62. As exemplified in FIG. 3, the lid 56 is bonded by an adhesive 57 to a surface 54*a* of the side of the support plate 54 opposite the flexible film 52 so as to cover the spaces SG such that the nozzle plate 62 is exposed from the nozzle-plate opening 622. In other words, the lid 56 is bonded by the adhesive 57 to the surface 54*a* of the support plate 54 so that the lid 56 covers, across the spaces SG, the flexible film 52 exposed from the flexible-film exposure openings 541 that is the walling flexible films 52*a*.

Since the spaces SG are provided, the walling flexible films 52*a* are likely to vary in accordance with the pressure variation of the ink in the storage chambers 34 compared to a structure where the spaces SG are not provided. Furthermore, covering the spaces SG by the lid 56 can prevent damage to walling flexible films 52*a*, which are exposed in the spaces SG, caused by contact of the walling flexible films 52*a* with another member.

The spaces SG each communicate with at least two of first to fourth external communication openings HA1 to HA4 that communicate with the outside of the liquid discharge head 20. Thus, air can move between the spaces SG and the outside of the liquid discharge head 20 in accordance with the variation of the walling flexible films 52*a*, and accordingly, movement of the walling flexible films 52*a* is facilitated.

Figure 4:
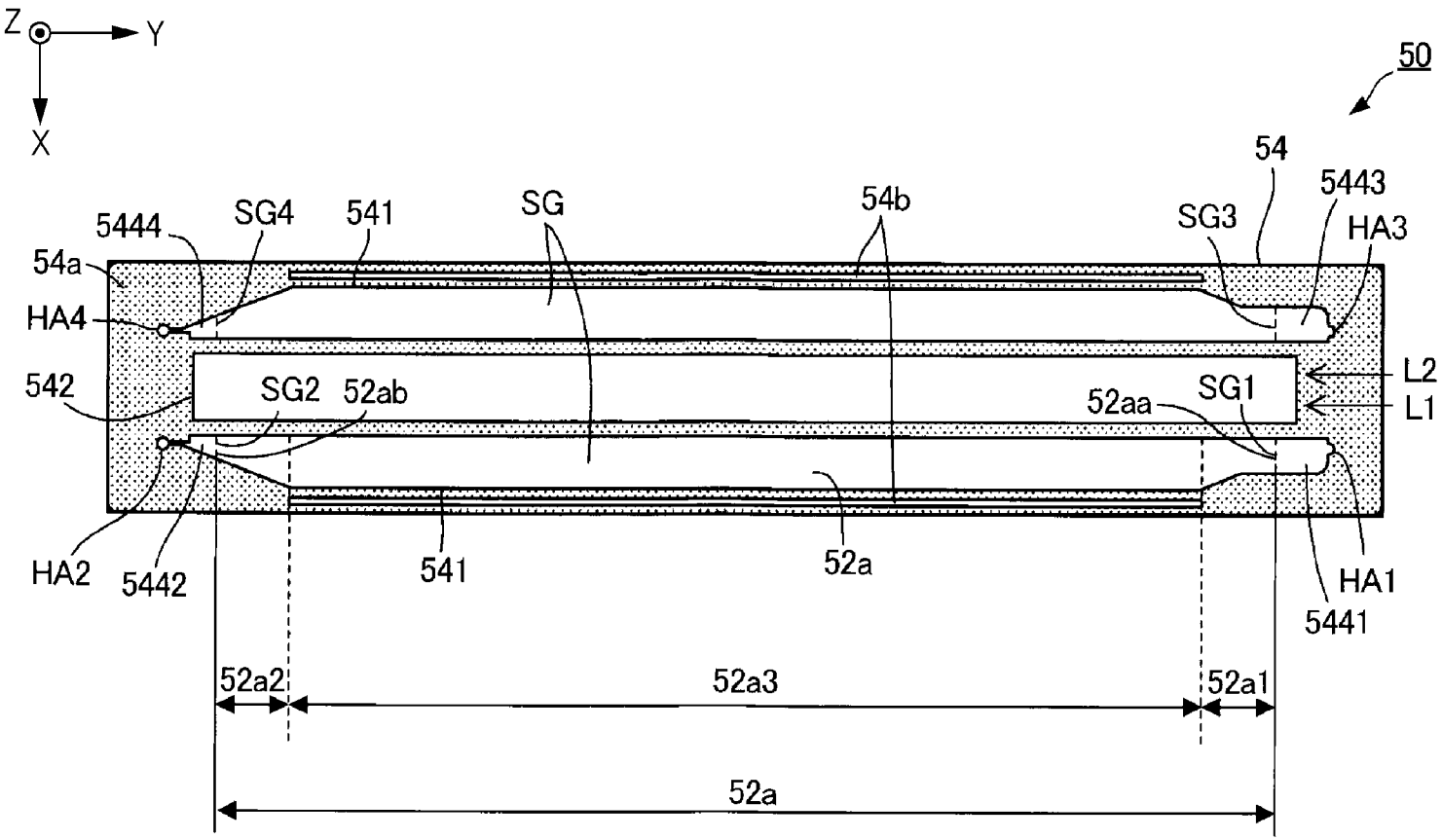
FIG. 4 is a plan view of a compliance plate.

As exemplified in FIG. 3, grooves 54*b* are provided in the surface 54*a* of the support plate 54 bonded to the lid 56, and the grooves 54*b* are each provided at a position opposite the nozzles N with a corresponding one of the spaces SG interposed therebetween. The adhesive 57 is also disposed in the grooves 54*b*. FIG. 4 illustrates the surface of the compliance plate 50, which includes the support plate 54 having the grooves 54*b*, on the positive side in the Z direction.

Since the adhesive 57 flows into the grooves 54*b*, compared to a structure in which grooves 54*b* are not provided, the area by which the adhesive 57 and the support plate 54 are in contact with each other increases, and further, an anchor effect is produced by the adhesive 57 flowing into the grooves 54*b*. Thus, the strength of bonding between the lid 56 and the support plate 54 can be increased. Accordingly, it is not required, for increasing the strength of bonding between the lid 56 and the support plate 54, to increase the sizes of a facing surface of the lid 56 and a facing surface of the support plate 54 where the lid 56 and the support plate 54 face each other. This can suppress formation of a gap between the lid 56 and the support plate 54 due to distortion or the like of the facing surfaces caused by the increase the sizes of the facing surfaces of the lid 56 and the support plate 54. Thus, the occurrences of clogging of the nozzles N or other troubles due to an increase in viscosity of the ink resulting from evaporation of water in the storage chambers 34 through the gap as described above and the flexible film 52 can be suppressed.

In the support plate 54, each of the grooves 54*b* is provided at a position opposite the nozzles N with a corresponding one of the space SG interposed therebetween. Thus, for example, even when the adhesive 57 flows into only part of one or each of the grooves 54*b* and part of the adhesive 57 spills from a space between the support plate 54 and the lid 56, the adhesive 57 having spilled is unlikely to reach the nozzles N. Thus, clogging of the nozzles N or other troubles caused by the adhesive 57 can be suppressed.

Although the grooves 54*b* penetrate through the support plate 54 in the example illustrated in FIGS. 2 to 4, the grooves 54*b* do not necessarily penetrate through the support plate 54. When the grooves 54*b* do not penetrate through the support plate 54, the stiffness of the support plate 54 can be improved compared to the structure where the grooves 54*b* penetrate through the support plate 54. With the support plate 54 having improved stiffness, bending of the support plate 54, and further, bending of the liquid discharge head 20 can be suppressed. Thus, reduction of accuracy of landing positions of the ink due to such bending can be suppressed.

As exemplified in FIGS. 2 and 4, when the grooves 54*b* penetrate through the support plate 54, compared to the structure in which the grooves 54*b* do not penetrate through the support plate 54, the contact area between the adhesive 57 and the grooves 54*b* can be increased, and accordingly, the strength of bonding between the lid 56 and the support plate 54 can be increased.

The shape of the grooves 54*b* is not limited to the shape illustrated in FIGS. 2 to 4 and can be appropriately changed. For example, the grooves 54*b* may have a shape the width of which reduces toward the bottoms of the grooves 54*b*.

As exemplified in FIGS. 2 and 4, the spaces SG extend in the Y direction. Each of the grooves 54*b* extends in the Y direction without being separated. For example, when the groove 54*b* is separated into a plurality of groove portions, the plurality of groove portions are independently of one another. Thus, the adhesive 57 flowing into one of the groove portions cannot move to another of the groove portions. Thus, the bonding strength with the adhesive 57 is likely to vary among the plurality of groove portions.

In contrast, as exemplified in FIGS. 2 and 4, when the groove 54*b* extends without being separated, the adhesive 57 flowing into part of the groove 54*b* can move to another part of the groove 54*b*. Thus, variation of the bonding strength with the adhesive 57 can be reduced over the entirety of the groove 54*b*. Accordingly, compared to the structure in which the groove 54*b* is separated into the plurality of groove portions, the strength of the bonding between the lid 56 and the support plate 54 can be increased.

As exemplified in FIG. 2, the first to fourth external communication openings HA1 to HA4 are provided in the case member 40, the channel member 32, the flexible film 52, and the support plate 54.

In a plan view seen in the Z direction, the first external communication opening HA' is located on the positive side in the Y direction relative to one end SG1, which is an end of one of the spaces SG corresponding to the first row L1, on the positive side in the Y direction. As exemplified in FIGS. 2 and 4, the one end SG1 of the space SG corresponding to the first row L1 communicates with a first communication passage 5441 that communicates with the first external communication opening HA'.

In a plan view seen in the Z direction, the second external communication opening HA2 is located on the negative side in the Y direction relative to another end SG2, which is an end of the space SG corresponding to the first row L1, on the negative side in the Y direction. As exemplified in FIGS. 2 and 4, the other end SG2 of the space SG corresponding to the first row L1 communicates with a second communication passage 5442 that communicates with the second external communication opening HA2.

The first communication passage 5441, the second communication passage 5442, and the first and second external communication openings HA', HA2 in the support plate 54 are, together with the space SG corresponding to the first row L1, surrounded by one of the flexible-film exposure openings 541 corresponding to the first row L1.

In a plan view seen in the Z direction, the third external communication opening HA3 is located on the positive side in the Y direction relative to one end SG3, which is an end of one of the spaces SG corresponding to the second row L2, on the positive side in the Y direction. As exemplified in FIGS. 2 and 4, the one end SG3 of the space SG corresponding to the second row L2 communicates with a first passage 5443 that communicates with the third external communication opening HA3.

In a plan view seen in the Z direction, the fourth external communication opening HA4 is located on the negative side in the Y direction relative to another end SG4, which is an end of the space SG corresponding to the second row L2, on the negative side in the Y direction. As exemplified in FIGS. 2 and 4, the other end SG4 of the space SG corresponding to the second row L2 communicates with a second passage 5444 that communicates with the fourth external communication opening HA4.

The first passage 5443, the second passage 5444, and the third and fourth external communication openings HA3, HA4 in the support plate 54 are, together with the space SG corresponding to the second row L2, surrounded by one of the flexible-film exposure openings 541 corresponding to the second row L2.

As exemplified in FIG. 4, the walling flexible film 52*a* corresponding to the first row L1 has a first region 52*a*1, a second region 52*a*2, and a third region 52*a*3. The first region 52*a*1 is an example of a first flexible region. The second region 52*a*2 is an example of a second flexible region. The first region 52*a*1 includes one end 52*aa* of one of the walling flexible films 52*a* corresponding to the first row L1 on the positive side in the Y direction. The second region 52*a*2 includes another end 52*ab* of the walling flexible film 52*a* corresponding to the first row L1 on the negative side in the Y direction. The third region 52*a*3 is a region between the first region 52*a*1 and the second region 52*a*2. The width of the third region 52*a*3 in the X direction is uniform. The largest width of the first region 52*a*1 in the X direction is smaller than the width of the third region 52*a*3 in the X direction. The largest width of the second region 52*a*2 in the X direction is smaller than the width of the third region 52*a*3 in the X direction.

As exemplified in FIGS. 2 and 4, in the X direction, the smallest width of the second region 52*a*2 is smaller than the smallest width of the first region 52*a*1.

When both of the smallest width of the first region 52*a*1 and the smallest width of the second region 52*a*2 are excessively small, a smallest width portion of each of the first region 52a1 and the second region 52a2 is unlikely to be bent. This causes a first problem in that the pressure variation in the storage chamber 34 is unlikely to be absorbed by variation of the walling flexible film 52a.

In contrast, when both of the smallest width of the first region 52a1 and the smallest width of the second region 52a2 are excessively large, the walling flexible film 52a is largely bent. This causes a second problem in that the flexible film 52 is easily removed from the channel member 32.

According to the present embodiment, the occurrences of a situation in which both of the smallest width of the first region 52a1 and the smallest width of the second region 52a2 are excessively small or excessively large can be suppressed. Accordingly, the occurrences of the first and second problems can be avoided.

Furthermore, the smallest width of the first region 52a1 is larger than the smallest width of the second region 52a2. Thus, the water in the ink evaporates more easily in the smallest width portion of the first region 52a1 than in the smallest width portion of the second region 52a2. In addition, the air easily moves between the outside of the liquid discharge head 20 and the space SG. Thus, the water evaporating from the first region 52a1 is easily discharged to the outside of the liquid discharge head 20.

As exemplified in FIGS. 2 and 4, the shape of the first region 52a1 is different from the shape of the second region 52a2. This can reduce the likelihood of each of the first region 52a1 and the second region 52a2 having a shape that is excessively easily to be bent or a shape that is excessively difficult to be bent.

Second Embodiment

Next, a second embodiment is described. In exemplifications described below, elements having similar functions to those of the first embodiment are denoted by the reference signs used for the first embodiment, thereby appropriately omitting detailed description.

Figure 5:
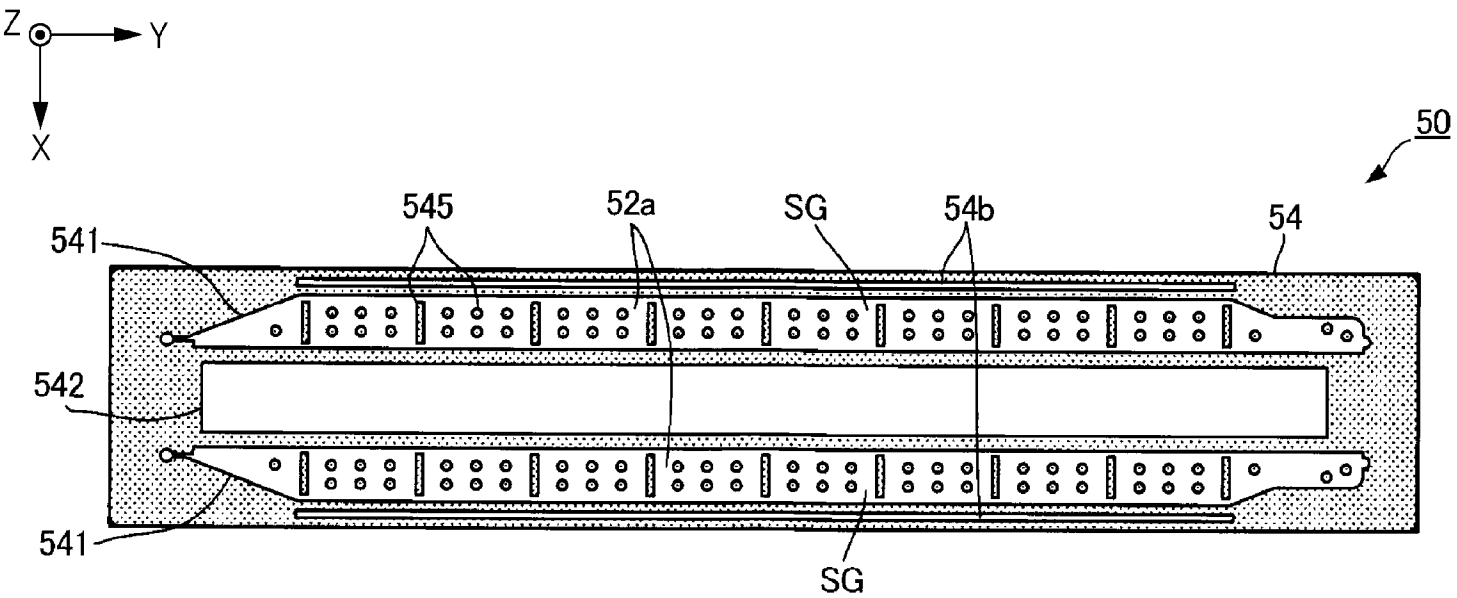
FIG. 5 is a plan view of a compliance plate according to a second embodiment.

FIG. 5 illustrates the compliance plate 50 according to the second embodiment. In the spaces SG exemplified in FIG. 5, regulating members 545 are provided between the walling flexible films 52a and the lid 56 so as to regulate contact between the walling flexible films 52a and the lid 56.

According to the present embodiment, a plurality of projections projecting from the walling flexible films 52a toward the lid 56 are used as the regulating members 545. The regulating members 545 are secured to the walling flexible films 52a by an adhesive. As exemplified in FIG. 5, the regulating members 545 are provided separately from the support plate 54 and independently of the support plate 54.

According to the second embodiment, the regulating members 545 are provided. This can suppress the occurrences of failure in which the walling flexible films 52a are bent toward the lid 56 more largely than required, resulting in removal of the flexible film 52 from the channel member 32.

When dust or the like is attracted to the regulating members 545, there occurs a problem in that flow of the air in the spaces SG becomes poor, and the walling flexible films 52a are unlikely to be bent. However, since the regulating members 545 are provided at positions separated from the support plate 54, the air can pass through both sides of the regulating members 545. Accordingly, attraction of dust or the like to the regulating members 545 can be reduced, and a situation in which the walling flexible films 52a are unlikely to be bent can be suppressed.

The regulating members 545 may be secured by an adhesive to the lid 56 instead of being secured to the walling flexible films 52a. Furthermore, the number, positions, and shape of the regulating members 545 can be appropriately changed. For example, the length of the regulating members 545 in the Z direction may be smaller than the length of the support plate 54 in the Z direction, that is, the thickness of the support plate 54.

Third Embodiment

Figure 6:
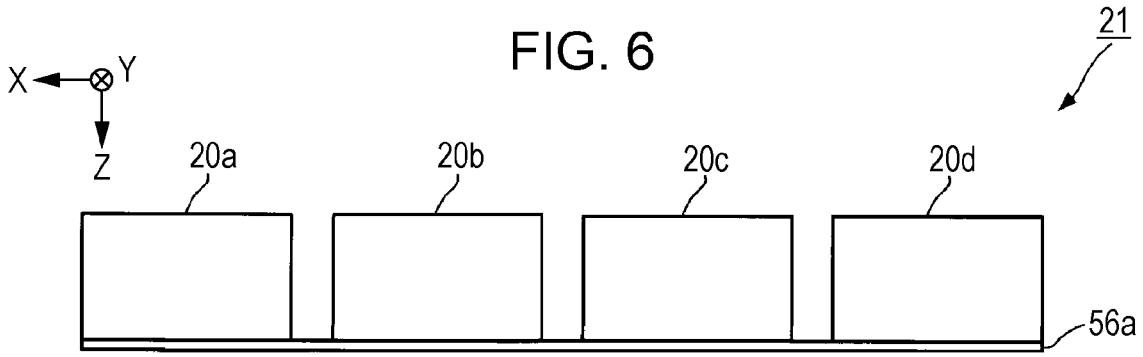
FIG. 6 illustrates a head unit used for a third embodiment.

Next, a third embodiment is described. FIG. 6 illustrates a head unit 21 used for the third embodiment. As exemplified in FIG. 6, the head unit 21 includes a first liquid discharge head 20a, a second liquid discharge head 20b, a third liquid discharge head 20c, and a fourth liquid discharge head 20d. The head unit 21 is mounted on the carriage 18 illustrated in FIG. 1 and discharges the ink.

Hereinafter, in the case where it is not required to distinguish the first liquid discharge head 20a, the second liquid discharge head 20b, the third liquid discharge head 20c, and the fourth liquid discharge head 20d from one another, each of the first to fourth liquid discharge heads 20a to 20d is referred to as "liquid discharge head 20e".

The structure of the liquid discharge heads 20e is the same as the structure of the liquid discharge head 20 according to the second embodiment with the lid 56 removed. The liquid discharge heads 20e discharge, for example, inks of different colors. The flexible-film exposure openings 541 of the liquid discharge heads 20e are covered with a common lid 56a used in common for the liquid discharge heads 20e. The common lid 56a is an example of a lid.

Figure 7:
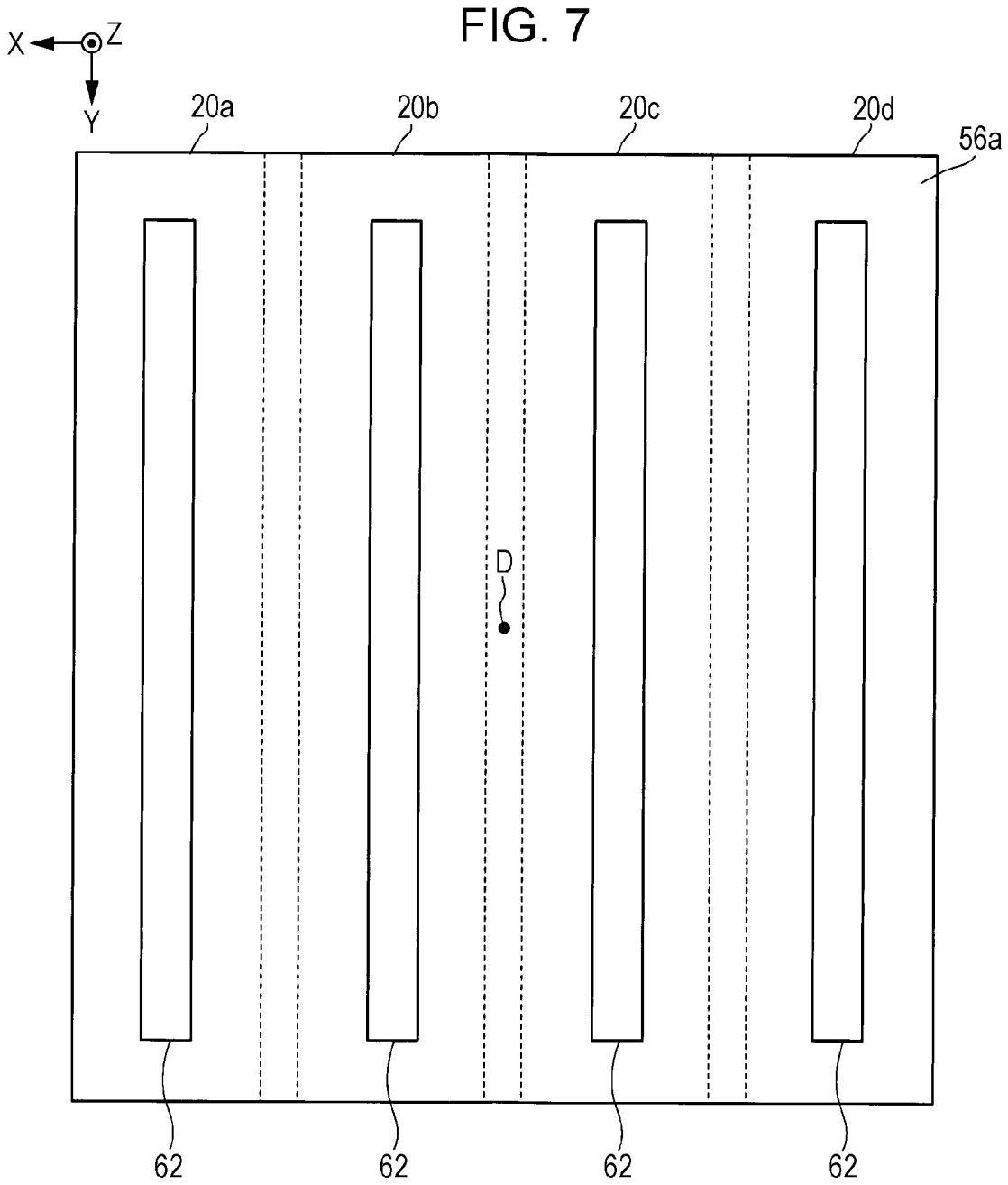
FIG. 7 illustrates arrangement of a first liquid discharge head, a second liquid discharge head, a third liquid discharge head, and a fourth liquid discharge head in the X-Y plane.

FIG. 7 illustrates arrangement of the first liquid discharge head 20a, the second liquid discharge head 20b, the third liquid discharge head 20c, and the fourth liquid discharge head 20d in the X-Y plane. The fourth liquid discharge head 20d, the third liquid discharge head 20c, the second liquid discharge head 20b, and the first liquid discharge head 20a are equally spaced from one another in the X direction.

The first liquid discharge head 20a and the fourth liquid discharge head 20d are in such a positional relationship that the first liquid discharge head 20a and the fourth liquid discharge head 20d are arranged point symmetrically with each other. Specifically, in a plan view seen in the Z direction, the first liquid discharge head 20a and the fourth liquid discharge head 20d are arranged point symmetrically with each other about a center D of a circumscribed circle that circumscribes the common lid 56a. Furthermore, the second liquid discharge head 20b and the third liquid discharge head 20c are arranged point symmetrically with each other about the center D.

Figure 8:
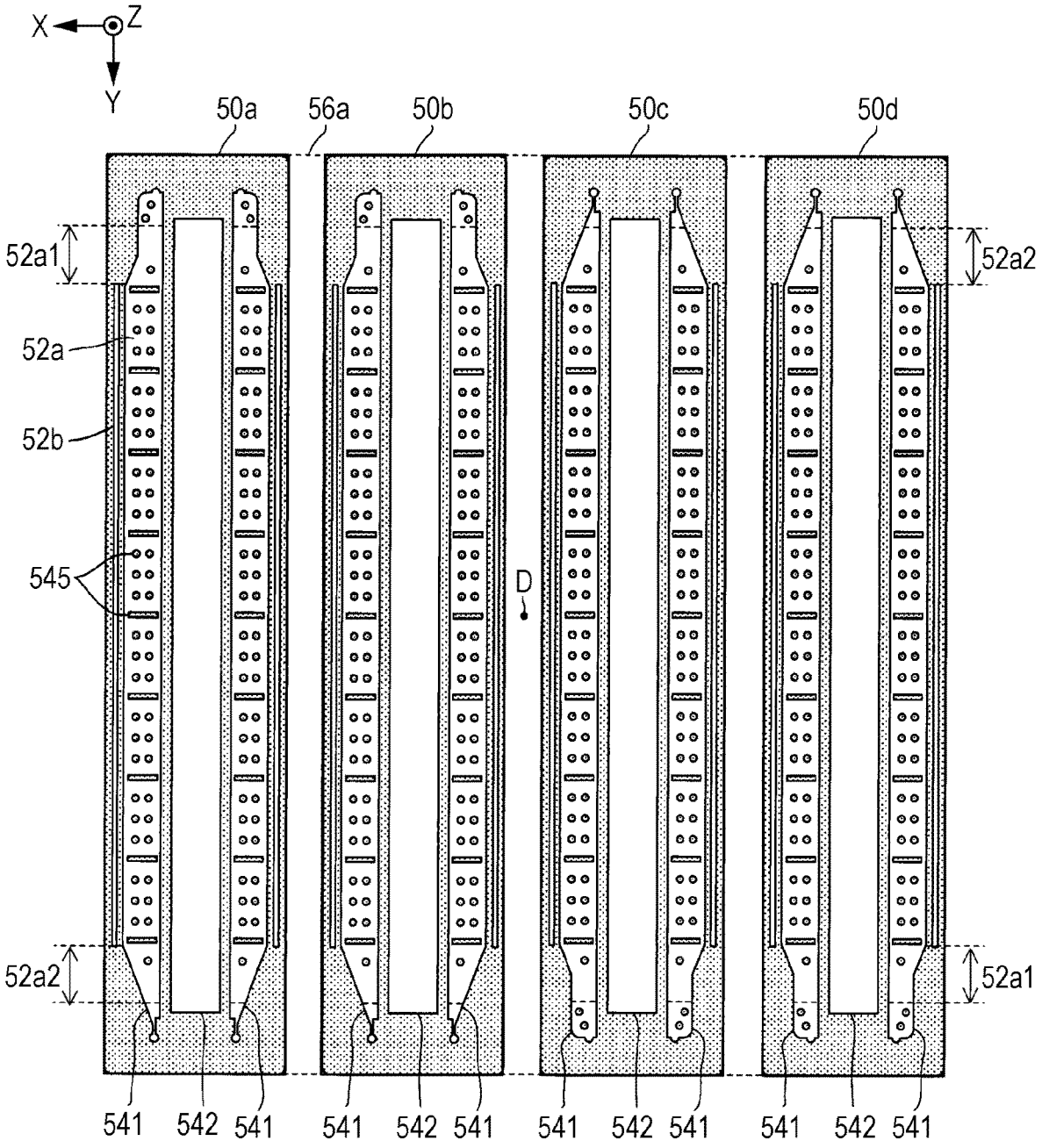
FIG. 8 illustrates the arrangement of the first liquid discharge head, the second liquid discharge head, the third liquid discharge head, and the fourth liquid discharge head in the X-Y plane of the respective compliance plates.

FIG. 8 illustrates the arrangement of the first liquid discharge head 20a, the second liquid discharge head 20b, the third liquid discharge head 20c, and the fourth liquid discharge head 20d in the X-Y plane of the respective compliance plates 50. In FIG. 8, the compliance plates 50 of the first liquid discharge head 20a, the second liquid discharge head 20b, the third liquid discharge head 20c, and the fourth liquid discharge head 20d are, for convenience, respectively represented as a compliance plate 50a, a compliance plate 50b, a compliance plate 50c, and a compliance plate 50d.

As exemplified in FIG. 8, the compliance plate 50 of the first liquid discharge head 20a and the compliance plate 50 of the fourth liquid discharge head 20d are arranged point symmetrically with each other about the center D. Accordingly, when seen in the X direction, the entirety of the first region 52*a*1 of the first liquid discharge head 20*a* and the entirety of the second region 52*a*2 of the fourth liquid discharge head 20*d* overlap, and the entirety the second region 52*a*2 of the first liquid discharge head 20*a* and the entirety of the first region 52*a*1 of the fourth liquid discharge head 20*d* overlap.

Instead, when seen in the X direction, the first region 52*a*1 of the first liquid discharge head 20*a* and the second region 52*a*2 of the fourth liquid discharge head 20*d* may partially overlap, and the second region 52*a*2 of the first liquid discharge head 20*a* and the first region 52*a*1 of the fourth liquid discharge head 20*d* may partially overlap. For example, the first liquid discharge head 20*a* and the second liquid discharge head 20*b* may be offset in the Y direction from the third liquid discharge head 20*c* and the fourth liquid discharge head 20*d*.

As exemplified in FIGS. 2 and 4, as the width of the walling flexible films 52*a* in the X direction increases, the width of the flexible-film exposure openings 541 in the X direction increases and the stiffness of the support plate 54 reduces. Also according to the present embodiment, in the X direction, the smallest width of the second region 52*a*2 is smaller than the smallest width of the first region 52*a*1. Accordingly, in the support plate 54, the stiffness of a portion around the first region 52*a*1 is different from the stiffness of a portion around the second region 52*a*2.

According to the present embodiment, when seen in the X direction, at least part of the first region 52*a*1 of the first liquid discharge head 20*a* and at least part of the second region 52*a*2 of the fourth liquid discharge head 20*d* overlap, and at least part of the second region 52*a*2 of the first liquid discharge head 20*a* and at least part of the first region 52*a*1 of the fourth liquid discharge head 20*d* overlap.

Thus, portions having low stiffness can be varied in the Y direction among the support plates 54, and accordingly, nonuniformity of the head unit 21 in stiffness can be reduced. This can suppress bending of the head unit 21 caused by nonuniformity in stiffness of the head unit 21, and further, suppress bending of the nozzle plate 62. Thus, reduction of accuracy of landing positions of the ink due to such bending can be suppressed.

Here, the following elements that correspond to the first row L1 of the first liquid discharge head 20*a* respectively exemplify a first storage chamber, a first flexible film, a first flexible region, a second flexible region, a first space, and a first opening: the storage chamber 34, the walling flexible film 52*a*, the first region 52*a*1, the second region 52*a*2, the space SG, and the flexible-film exposure opening 541. The channel member 32 and the support plate 54 of the first liquid discharge head 20*a* respectively exemplify a first channel member and a first support. The following elements that correspond to the first row L1 of the fourth liquid discharge head 20*d* respectively exemplify a second storage chamber beside the first storage chamber along the second axis, a second flexible film, a second space, a second opening, a third communication passage, a fourth communication passage, a third flexible region, and a fourth flexible region: the storage chamber 34, the walling flexible film 52*a*, the space SG, the flexible-film exposure opening 541, the first communication passage 5441 with which the space SG communicates, the second communication passage 5442 with which the space SG communicates, the first region 52*a*1, and the second region 52*a*2. The channel member 32 and the support plate 54 of the fourth liquid discharge head 20*d* respectively exemplify a second channel member and a second support. It is sufficient that two or more liquid discharge heads 20*e* be mounted on the head unit 21.

VARIATIONS

The above-described embodiments can be varied in a variety of manners. Specific forms applicable to the embodiments are exemplified as follows. Two or more of the forms arbitrarily selected from among the following exemplifications can be appropriately combined as long as no conflict occurs between the selected two or more forms.

1. The driver element that discharges the liquid contained in the pressure chamber C from the nozzle N is not limited to the piezoelectric element 385 exemplified for the embodiments. For example, a heating element that generates heat so as to generate bubbles in the pressure chamber C for variation of the pressure may be used as the driver element. As can be understood from the above-described exemplifications, the driver element is generally represented as an element that ejects the liquid contained in the pressure chamber C from the nozzle N, and typically, as an element that applies pressure to the inside of the pressure chamber C. Here, the driver element may be operated in any method, for example, a piezoelectric method or a heating method and may have any specific structure.

2. Although a serial scan liquid discharge device 10 in which the carriage 18 on which the liquid discharge head 20 is mounted reciprocates has been described according to the above-described embodiments, the present disclosure can be applied also to a line scan liquid discharge device in which the plurality of nozzles N are distributed throughout the width of the medium 11.

3. The liquid discharge device 10 exemplified according to the above-described embodiments can be used for any of a variety of apparatuses such as facsimile machines and copiers other than apparatuses dedicated to printing. Furthermore, application of the liquid discharge device 10 is not limited to printing. For example, a liquid discharge device that discharges a solution of colorant is used as any of manufacturing devices that form color filters of liquid crystal displays. Furthermore, a liquid discharge device that discharges a solution of a conductive material is used as any of manufacturing devices that form wiring or electrodes of wiring substrates. Furthermore, a liquid discharge device that discharges a solution of biological organic matter is used as, for example, any of manufacturing devices that fabricate biochips.

What is claimed is:

1. A liquid discharge device comprising:

a channel member having a storage chamber that stores liquid;

a nozzle plate having a nozzle through which the liquid stored in the storage chamber is discharged;

a flexible film configured to form part of walling of the storage chamber;

a support having an opening configured to surround a space where the flexible film is exposed at a side of the flexible film opposite the storage chamber; and a lid configured to cover the flexible film across the space, the lid being bonded, by an adhesive, to a surface of the support, wherein, the support has a groove provided in the surface bonded to the lid, wherein the adhesive is also disposed in the groove, wherein a liquid discharge head that discharges the liquid includes the channel member, the nozzle plate, the flexible film,
the support, and
the lid, wherein
the space and the flexible film extend along a first axis, wherein
one end of the space along the first axis communicates with a first communication passage that communicates with outside of the liquid discharge head, wherein
another end of the space along the first axis communicates with a second communication passage that communicates with the outside, wherein
the flexible film includes
a first flexible region including one end of the flexible film along the first axis and
a second flexible region including another end of the flexible film along the first axis, and wherein,
along a second axis that intersects both the first axis and a thickness axis of the flexible film, a smallest width of the second flexible region is smaller than a smallest width of the first flexible region.

2. The liquid discharge device according to claim 1, wherein
the space extends along a first axis, and wherein
the groove extends along the first axis without being separated.

3. The liquid discharge device according to claim 1, further comprising:
a regulating member located between the flexible film and the lid in the space so as to regulate contact between the flexible film and the lid, wherein
the regulating member is provided separately from the support plate.

4. The liquid discharge device according to claim 1, wherein
the storage chamber is a first storage chamber, wherein
the channel member is a first channel member, wherein
the flexible film is a first flexible film, wherein
the space is a first space, wherein
the opening is a first opening, wherein
the support is a first support, wherein
the liquid discharge device further includes
a second channel member having a second storage chamber that is disposed beside the first storage chamber along the second axis,
a second flexible film that forms part of walling of the second storage chamber, and
a second support having a second opening that surrounds a second space where the second flexible film is exposed at a side of the second flexible film opposite the second storage chamber, wherein
the lid is configured to cover the second flexible film across the second space, the lid being bonded, by the adhesive, to a surface of the second support, wherein
the liquid discharge head further includes
the second channel member,
the second flexible film, and
the second support, wherein
the second space and the second flexible film extend along the first axis, wherein
one end of the second space along the first axis communicates with a third communication passage that communicates with the outside, wherein
another end of the second space along the first axis communicates with a fourth communication passage that communicates with the outside, wherein
the second flexible film includes
a third flexible region including one end of the second flexible film along the first axis and
a fourth flexible region including another end of the second flexible film along the first axis, wherein,
along the second axis, a smallest width of the fourth flexible region is smaller than a smallest width of the third flexible region, and wherein,
when seen along the second axis, at least part of the first flexible region and at least part of the fourth flexible region overlap, and at least part of the second flexible region and at least part of the third flexible region overlap.

5. A liquid discharge device comprising:
a channel member having a storage chamber that stores liquid;
a nozzle plate having a nozzle through which the liquid stored in the storage chamber is discharged;
a flexible film configured to form part of walling of the storage chamber;
a support having an opening configured to surround a space where the flexible film is exposed at a side of the flexible film opposite the storage chamber; and
a lid configured to cover the flexible film across the space, the lid being bonded, by an adhesive, to a surface of the support, wherein,
the support has a groove provided in the surface bonded to the lid, wherein
the adhesive is also disposed in the groove, wherein
a liquid discharge head that discharges the liquid includes
the channel member,
the nozzle plate,
the flexible film,
the support, and
the lid, wherein
the space and the flexible film extend along a first axis, wherein
one end of the space along the first axis communicates with a first communication passage that communicates with outside of the liquid discharge head, wherein
another end of the space along the first axis communicates with a second communication passage that communicates with the outside, wherein
the flexible film includes
a first flexible region including one end of the flexible film along the first axis and
a second flexible region including another end of the flexible film along the first axis, and wherein
a shape of the first flexible region is different from a shape of the second flexible region.

6. The liquid discharge device according to claim 5, wherein
the space extends along a first axis, and wherein
the groove extends along the first axis without being separated.

7. The liquid discharge device according to claim 5, further comprising:
a regulating member located between the flexible film and the lid in the space so as to regulate contact between the flexible film and the lid, wherein
the regulating member is provided separately from the support plate.

8. The liquid discharge device according to claim 5, wherein
the storage chamber is a first storage chamber, wherein
the channel member is a first channel member, wherein
the flexible film is a first flexible film, wherein
the space is a first space, wherein the opening is a first opening, wherein the support is a first support, wherein the liquid discharge device further includes a second channel member having a second storage chamber that is disposed beside the first storage chamber along the second axis, a second flexible film that forms part of walling of the second storage chamber, and a second support having a second opening that surrounds a second space where the second flexible film is exposed at a side of the second flexible film opposite the second storage chamber, wherein the lid is configured to cover the second flexible film across the second space, the lid being bonded, by the adhesive, to a surface of the second support, wherein the liquid discharge head further includes the second channel member, the second flexible film, and the second support, wherein the second space and the second flexible film extend along the first axis, wherein one end of the second space along the first axis communicates with a third communication passage that communicates with the outside, wherein another end of the second space along the first axis communicates with a fourth communication passage that communicates with the outside, wherein the second flexible film includes a third flexible region including one end of the second flexible film along the first axis and a fourth flexible region including another end of the second flexible film along the first axis, wherein, along the second axis, a smallest width of the fourth flexible region is smaller than a smallest width of the third flexible region, and wherein, when seen along the second axis, at least part of the first flexible region and at least part of the fourth flexible region overlap, and at least part of the second flexible region and at least part of the third flexible region overlap.

* * * * *